US006497375B1

(12) United States Patent
Srinath et al.

(10) Patent No.: US 6,497,375 B1
(45) Date of Patent: Dec. 24, 2002

(54) FLUIDIC NOZZLE WITH MULTIPLE OPERATING MODES

(75) Inventors: Dharapuram N. Srinath, Ellicott City, MD (US); Sean T. Burns, Columbia, SC (US)

(73) Assignee: Bowles Fluidics Corporation, Columbia, MD (US)

( * ) Notice: Subject to any disclaimer, the term of this patent is extended or adjusted under 35 U.S.C. 154(b) by 61 days.

(21) Appl. No.: 09/785,521

(22) Filed: Feb. 20, 2001

Related U.S. Application Data

(60) Provisional application No. 60/183,809, filed on Feb. 22, 2000.

(51) Int. Cl.[7] ..... B05B 1/08

(52) U.S. Cl. ..... 239/589.1; 239/101; 239/407; 239/419.5; 239/428.5; 239/DIG. 3; 239/DIG. 7; 137/803; 137/826; 137/833

(58) Field of Search ..... 239/284.1, 407, 239/419, 419.5, 101, 428.5, 589, 589.1, DIG. 3, DIG. 7; 137/803, 825, 826, 833, 835; 4/541.1, 541.3–541.6

(56) References Cited

U.S. PATENT DOCUMENTS 3,468,325 A 9/1969 Bowles
3,563,462 A * 2/1971 Bauer ..... 239/589.1
3,630,217 A * 12/1971 Bell ..... 137/835
3,741,481 A * 6/1973 Bauer ..... 239/589.1
3,776,460 A * 12/1973 Fichter ..... 239/101
4,122,845 A * 10/1978 Stouffer et al. ..... 239/589.1

* cited by examiner

*Primary Examiner*—Steven J. Ganey
(74) *Attorney, Agent, or Firm*—Jim Zegeer

(57) ABSTRACT

A fluidic nozzle having multiple operating modes comprising a fluidic oscillator circuit having an oscillation chamber having an upstream end and a downstream end and a power nozzle at the upstream end for introducing a jet of a liquid (water) into the oscillation chamber. An outlet throat at the downstream end has a width, which does not allow the oscillation circuit to fill up and start to oscillate without entrained liquid. A pair of control ports are at the upstream end of the oscillation chamber and a pair of feedback passages connect said control ports to downstream ends of said oscillation chamber adjacent said outlet throat. A pair of controllable entrainment holes are provided in the oscillation chamber at the upstream end and a valve opens and closes the entrainment holes, such that when the entrainment holes are open to air, air is entrained and the oscillator does not oscillate. Closing the air entrainment holes initiates oscillation and the issuance of a sweeping liquid jet through the outlet throat.

3 Claims, 3 Drawing Sheets

FLUIDIC NOZZLE WITH MULTIPLE OPERATING MODES

REFERENCE TO RELATED APPLICATION

This application is the subject of provisional application Serial No. 60/183,809 filed Feb. 22, 2000 entitled FLUIDIC NOZZLE WITH DUAL OPERATING MODES.

BACKGROUND AND BRIEF DESCRIPTION OF THE INVENTION

In many nozzle applications where liquid such as water is being projected into a hot tub spa, it is desirable that the liquid spray nozzle issue a spray which oscillates between a certain included angle between the extreme positions of the jet for massaging effect and also that the jet of liquid used (water) be mixed with emollients or other operating liquids in one mode of operation, and in another mode of operation that air be entrained with the water.

The present invention provides a fluidic nozzle having multiple operating modes wherein a fluidic oscillator circuit having an oscillation chamber with an upstream end and a downstream. A power nozzle is positioned at the upstream end for introducing a jet of liquid such as water into the oscillation chamber. An outlet is provided at the downstream end of the oscillation chamber and has a width which does not allow the oscillation circuit to fill up and start oscillation without entrained liquid. A pair of control ports is provided at the upstream end of the oscillation chamber adjacent the power nozzle and a pair of feedback passages connects the control ports to the downstream ends of the oscillation chamber adjacent the outlet throat. A pair of air entrainment holes in the oscillation chamber is provided at the upstream end, and means for opening and closing the entrainment holes such that when the entrainment holes are open to air, air is entrained and the oscillation does not occur. When the entrainment holes are closed or connected to a source of liquid chemicals or emollients, oscillation is initiated to issue a sweeping jet of liquid through the outlet throat. Moreover, the means for opening and closing the entrainment holes can be coupled to a source of emollient liquid for mixing with the water from the power nozzle. Thus, there is disclosed a fluidic nozzle capable of operating in dual modes: (1) a straight jet or an unoscillating mode, and (2) an oscillating mode in which the nozzle issued a spray with certain included angles between the extreme positions of the jet. The mixing feature is a third mode.

The typical users include hot tub jets and sprayers where a chemical is mixed with the water or other operating liquids.

BRIEF DESCRIPTION OF THE DRAWINGS

The above and other objects, advantages and features of the invention will become more apparent when considered with the following specification and accompanying drawings wherein.

DETAILED DESCRIPTION OF THE DESCRIPTION

Figure 1:
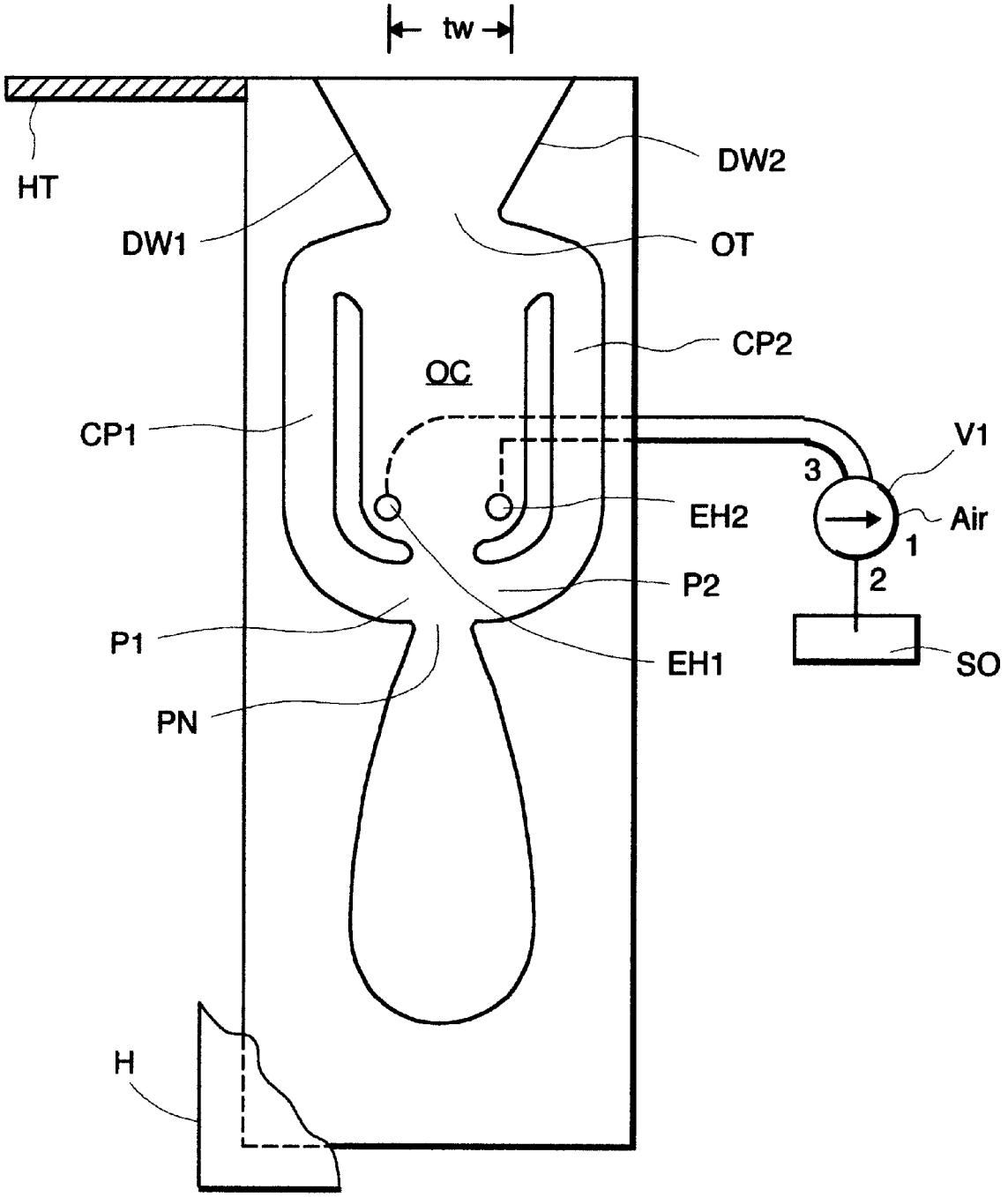
FIG. 1 shows the geometry of the fluidic oscillator device.

Referring to FIG. 1, the fluidic nozzle with dual operating modes is disclosed as having an oscillation chamber OC with an upstream end and a downstream end with a power nozzle PN at the upstream end for issuing a jet of liquid into the oscillation chamber OC and is connected to a source (not shown) of water under pressure. The downstream end is provided with an outlet throat OT with diverging sidewalls DW1, DW2. The throat width TW is such as to not allow the circuit to fill up with liquid to start to oscillate. A pair of entrainment holes EH1, EH2 is provided for entrainment of air or liquid emollients or chemicals.

A pair of control ports P1, P2 are provided adjacent the power nozzle PN, and a pair of control passages CP1, CP2 for feeding back control signals to the control ports CP1, CP2, respectively. A housing H is shown partially removed for clarity.

The entrainment holes EH1, EH2 are coupled through a valve member V1 to (1) air or (2) to a source SO of liquid or chemical emollients which is to be mixed with water for hot tub operation, (3) or close the entrainment holes EH1 and EH2.

Figure 2:
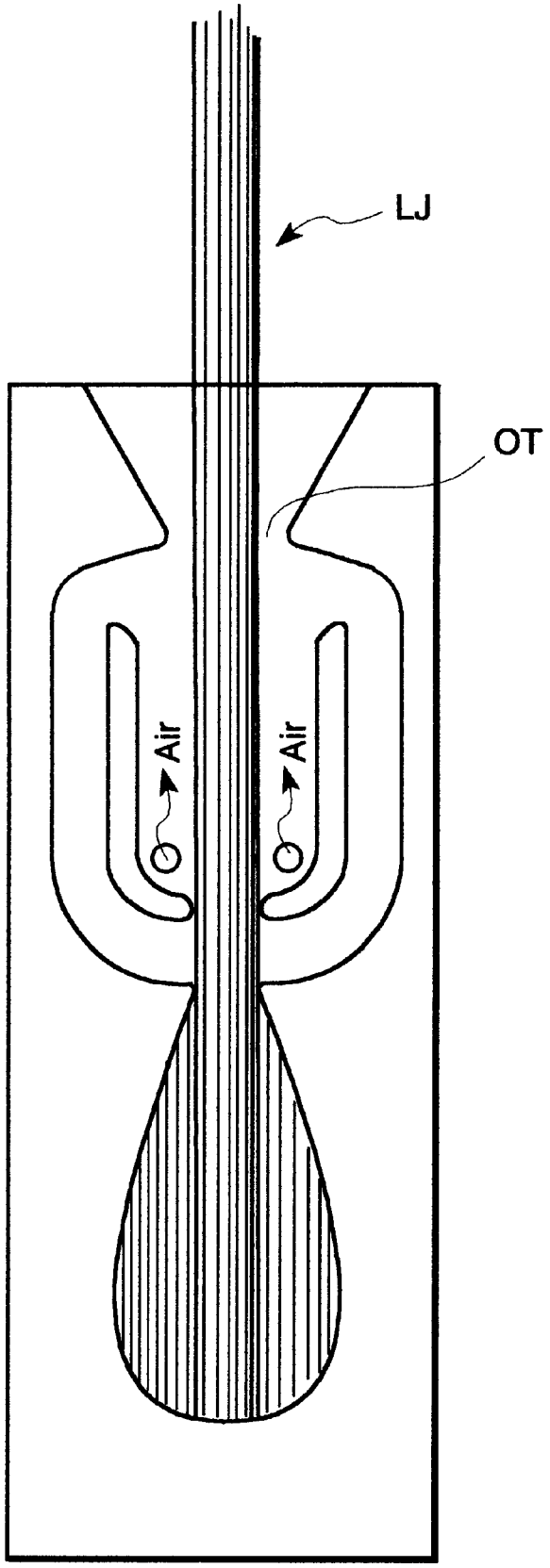
FIG. 2 shows the output flow pattern in a non-oscillating mode with air being entrained through air entrainment holes.

As shown in FIG. 2, water is issued through the power nozzle PN into the oscillation chamber OC. The outlet throat width TW is such as to not allow the circuit to fill up and start to oscillate without entrained liquid. In the condition shown in FIG. 2, the liquid jet LJ passes through the outlet throat OT into the liquid in the hot tub. As the jet of liquid flows into the oscillation chamber, air is entrained through the holes EH1, EH2 when the valve V1 is in position 1 so that the air mixes with water and flows out of the oscillation chamber and mixes with the water in the hot tub HT.

Figure 3:
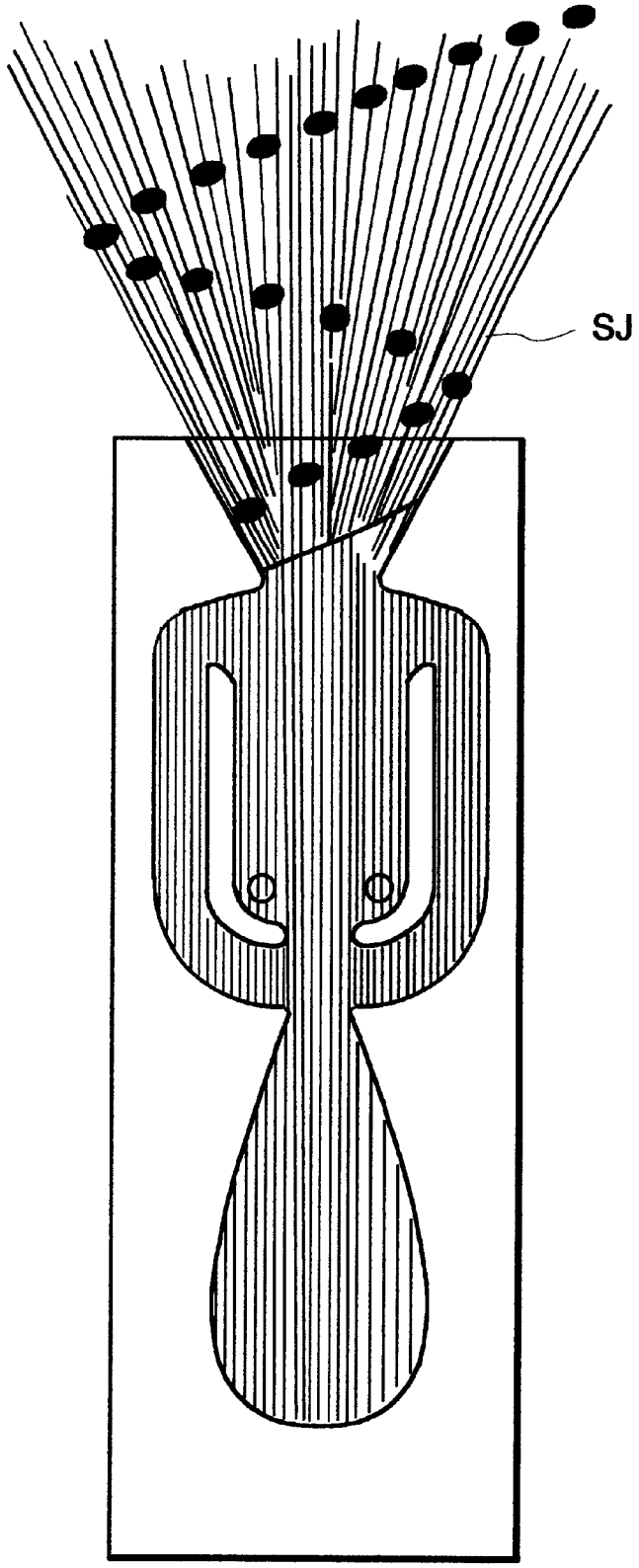
FIG. 3 shows the output flow pattern in an oscillating mode.

As shown in FIG. 3, with the valve V1 in position 2, the entrainment holes are closed and are immersed in a liquid such as the emollients to be added to the bath water. In this mode of operation, the oscillation chamber fills with liquid and oscillation ensues in the manner described in Stouffer U.S. Pat. No. 4,508,267.

A sweeping jet SJ of liquid is issued into the hot tub and mixed with it, if the valve V1 is connected to a source of other liquid, such as a chemical emollients is mixed in the oscillation chamber OC and then is dispersed with the sweeping jet into the hot tub.

Thus, there has been provided a fluidic nozzle having multiple operating modes comprising: a fluidic oscillator circuit having an oscillation chamber having an upstream end and a downstream end, a power nozzle at the upstream end for introducing a jet of a liquid (water) into the oscillation chamber. An outlet throat at the downstream end has a width which does not allow the oscillation circuit to fill up and start to oscillate without entrained liquid. A pair of control ports are at the upstream end of the oscillation chamber and a pair of feedback passages connect said control ports to downstream ends of said oscillation chamber adjacent said outlet throat. A pair of controllable entrainment holes are provided in the oscillation chamber at the upstream end and a valve opens and closes the entrainment holes, such that when the entrainment holes are open to air, air is entrained and the oscillator does not oscillate. Closing the air entrainment holes initiates oscillation and the issuance of a sweeping liquid jet through the outlet throat. The valve for opening and closing the entrainment holes can be coupled to a source of a second liquid for mixing with the water. In one preferred use of the invention, the nozzle is mounted in the wall of a hot tub spa and in another preferred use the nozzle can be used as a garden sprayer.

While the invention has been described in relation to preferred embodiments of the invention, it will be appreciated that other embodiments, adaptations and modifications of the invention will be apparent to those skilled in the art.

What is claimed is:

1. A fluidic nozzle having dual operating modes comprising:

a fluidic oscillator circuit having an oscillation chamber having an upstream end and a downstream end, a power nozzle at said upstream end for introducing a jet of a first liquid into said oscillation chamber, an outlet throat at said downstream end having a width which does not allow the oscillation circuit to fill up and start to oscillate without entrained liquid, a pair of control ports at the upstream end of said oscillation chamber and a pair of feedback passages connecting said control ports to downstream ends of said oscillation chamber adjacent said outlet throat, a pair of air entrainment holes in said oscillation chamber at said upstream end, and a valve element for opening and closing said entrainment holes such that when said entrainment holes are open air is entrained and said oscillator does not oscillate and when said entrainment holes are closed said oscillator oscillates to issue a sweeping jet of said first liquid through said outlet throat.

2. A fluidic nozzle having dual operating modes as defined in claim 1 wherein said valve element for opening and closing said entrainment holes is coupled to a source of a second liquid for mixing with said first liquid.

3. A hot tub spa having a plurality of jets in which at least one of said jets is provided by the nozzle defined in claim 2.

* * * * *